United States Patent [19]

Koppatsch

[11] Patent Number: 4,966,057

[45] Date of Patent: Oct. 30, 1990

[54] POWER WRENCH

[75] Inventor: Wolfgang Koppatsch, St. Augustin, Fed. Rep. of Germany

[73] Assignee: Paul-Heinz Wagner, Fed. Rep. of Germany

[21] Appl. No.: 507,094

[22] Filed: Apr. 9, 1990

Related U.S. Application Data

[63] Continuation of Ser. No. 290,407, Dec. 29, 1988, abandoned.

[30] Foreign Application Priority Data

Jan. 23, 1988 [DE] Fed. Rep. of Germany ..... 3801972

[51] Int. Cl.[5] ..... B25B 23/151

[52] U.S. Cl. ..... 81/469; 173/12; 173/163

[58] Field of Search ..... 81/429, 467, 469, 473; 173/12, 163; 74/801

[56] References Cited

U.S. PATENT DOCUMENTS

| | | | |
|---|---|---|---|
| 4,328,871 | 5/1982 | Gluskin | 173/12 |
| 4,513,827 | 4/1985 | Dubiel | 173/12 |
| 4,823,885 | 4/1989 | Okumura | 173/12 |

*Primary Examiner*—James G. Smith

*Attorney, Agent, or Firm*—Diller, Ramik & Wight

[57] ABSTRACT

The power wrench is provided with a coupling (14), switching dependent on the rotational moment and switching between a fast run mode and a load mode, when the rotational moment of the output exceeds a limit value. A distributing shaft (23) simulaneously drives two drive gears (26, 27). The output shaft (28) is pulled by a coupling member (32) that may be engaged to any one of said drive gears (26, 27). The coupling member (32) is prestressed by a spring (38) towards said first drive gear. At reaching the limit moment, the guiding member (40) shifts along the guide surface (39). This causes an axial movement of the coupling member (32) to disengage from said first drive gear (26) and to engage with said second drive gear (27).

23 Claims, 3 Drawing Sheets

POWER WRENCH

Figure 1:
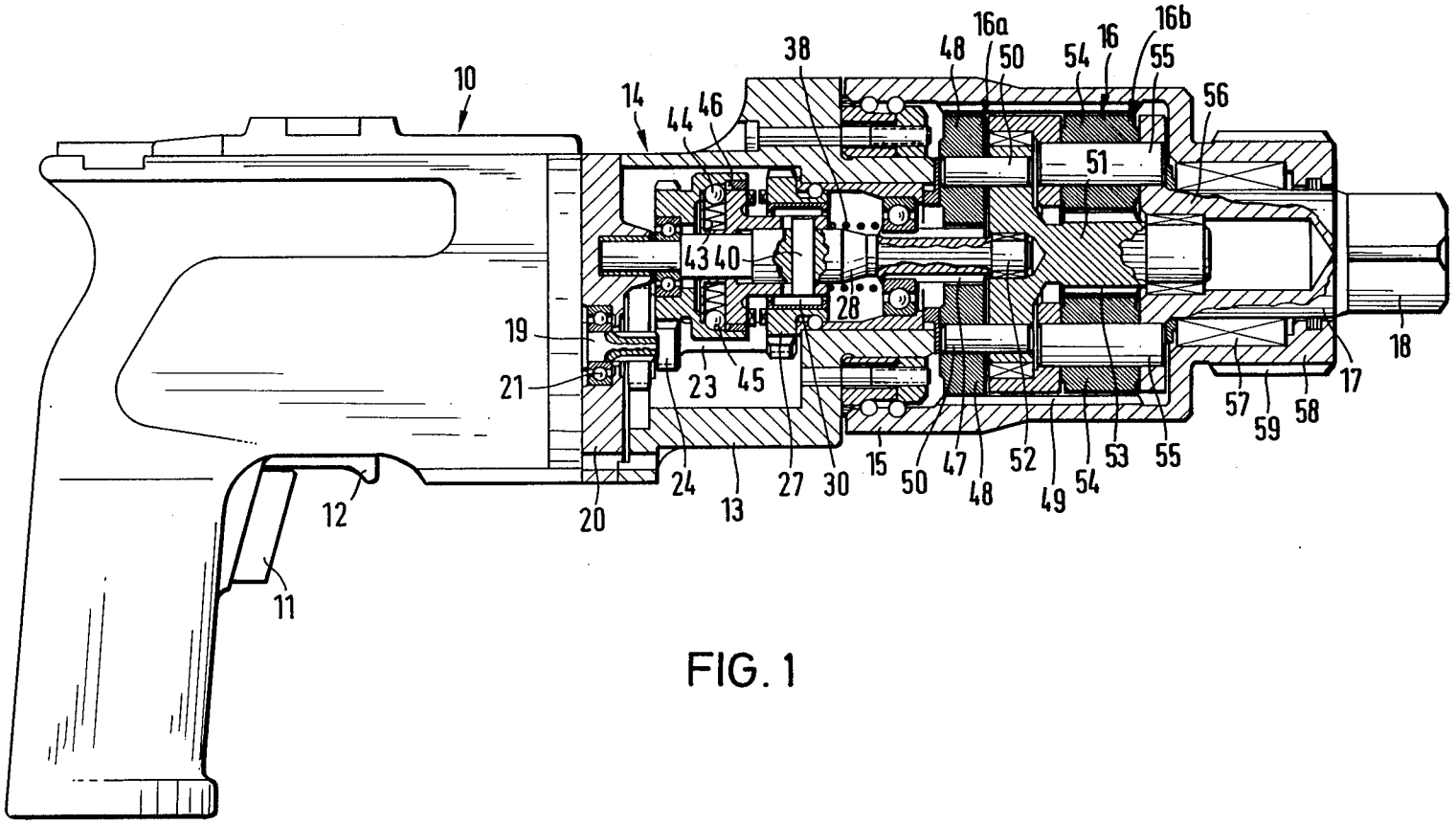

This application is a continuation, of application Ser. No. 07/290,407, filed Dec. 29, 1988 and now abandoned.

The invention relates to a power wrench.

When tightening a screw, it is expedient to first rotate the screw rapidly with a high number of revolutions and low rotational moment. Should the screw offer a high resistance to the screw driving device, the screw driving device should be driven at a lower number of rotations and a higher rotational moment to tighten the screw. When loosening a screw, a high rotational moment is first required, then a lower rotational moment is needed, which allows work to be accomplished at a higher number of rotations.

Motorized power drivers are known that allow a change in the number of rotations and, thus, the rotational moment, in dependence on the screw driving moment. Such change may be effected automatically. With a known power wrench driven by a hydraulic motor, for example, the advance pressure is detected and the power wrench is switched to a higher rotational moment, if the advance pressure exceeds a predetermined limiting value. In an electrically driven power wrench, the screw driving moment may be detected by monitoring the current.

Moreover, power drivers are known that have a ratchet coupling. At a low screw driving moment, the ratchet coupling is engaged, so that the output shaft is turned via the ratchet coupling. When the screw driving moment limit is surpassed, the ratchet coupling disengages and the output shaft is driven by a slower rotating shaft. It is a disadvantage hereof that the ratchet coupling is subjected to high mechanic stresses during operation and that it constantly produces impacts.

It is the object of the invention to provide a power wrench, which effects purely mechanical switching from a low rotational moment to a high rotational moment, without having to transform the rotational moment into another physical quantity to be measured and which works reliably and with only low wear.

According to the invention, the power of the drive shaft is transmitted to the engaging coupling via a distributing shaft in two different ways with different transmission ratios. At a low screw driving moment (load moment), the coupling member of the engaging coupling is engaged with the first drive gear, so that the output shaft is driven at a comparatively high first number of rotations, while the power transmission from the second drive gear to the engaging coupling is interrupted. In dependence on the load moment, the coupling member meshes with either the first drive gear or the second drive gear. The shifting of the coupling member is achieved by a force, generated by the load moment, that counteracts the pre-stress of the coupling member. Said coupling member can only mesh with either the first drive gear or the second drive gear, but never with both drive gears at the same time. The pre-stress of the coupling member can be effected by a spring device or by hydraulic means.

Preferably, said pre-stress is modified by external regulation to adjust the value of the load moment at which the switching is effected. Said coupling member is arranged on the output shaft, so as to be horizontally displacable, and it is pushed by the pre-stress into a direction in which it is operatively engaged with the first drive gear. When the load moment exceeds the limiting value, the pre-stressing device yields and through the effect of a guide curve, an axial displacement of the coupling member towards the second drive gear is achieved. At the same time the operative engagement between the coupling member and the first drive gear is disengaged, while the operative engagement between said coupling member and the second drive gear is established.

Preferably, one of the two engaging couplings is a claw coupling, whereas the other engaging coupling is a ball coupling. With a ball coupling, the driving is achieved between a coupling body, fixedly connected with said first drive gear, and a coupling member by spring-tensioned balls that are pressed against a noncircular track. A ball coupling of that type provides a sliding coupling, the coupling body and the coupling member of which can move relative to one another. To reduce the stress on the coupling components in case of said relative motion and to obtain a better utilization of the drive energy, a free circulation track for taking up the balls, when the other engaging coupling is in gear, is arranged adjacent to a track in the coupling body that is provided with the openings of the engaging coupling. Thus, the engaging coupling provided with balls has two tracks arranged side by side, with one being a drive track and the other being an idle run track. When the balls are in the drive track, the engaging coupling is in gear, whereas the engaging coupling is disengaged, when the balls run in the idle run track.

The power wrench according to the invention provides a smooth and impact-free switching from a low rotational moment to a high rotational moment or vice versa. Preferably, the guide curve, which, in combination with the pre-stress, effects the axial movement of the coupling member with respect to the output shaft in dependence on the load moment, has the shape of an equilateral triangle. Thus, a switching of the transmission ratio of the power wrench dependent on the rotational moment is achieved in both directions of rotation.

The following is a detailed description of preferred embodiments of the invention with reference to the drawings.

Figure 2:
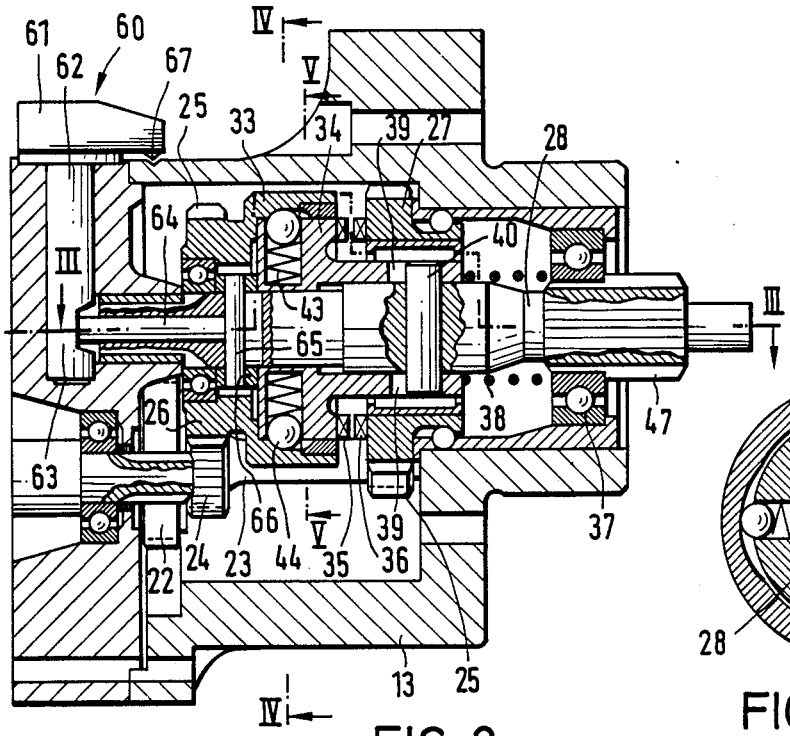
Figure 4:
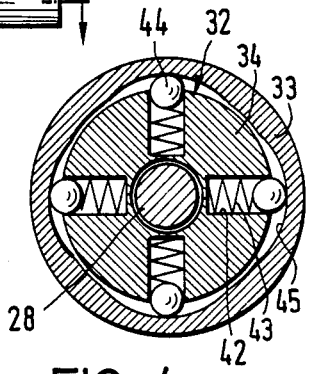
Figure 5:
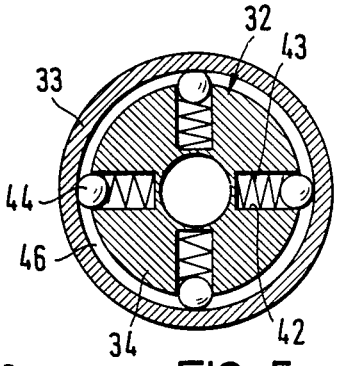
Figure 6:
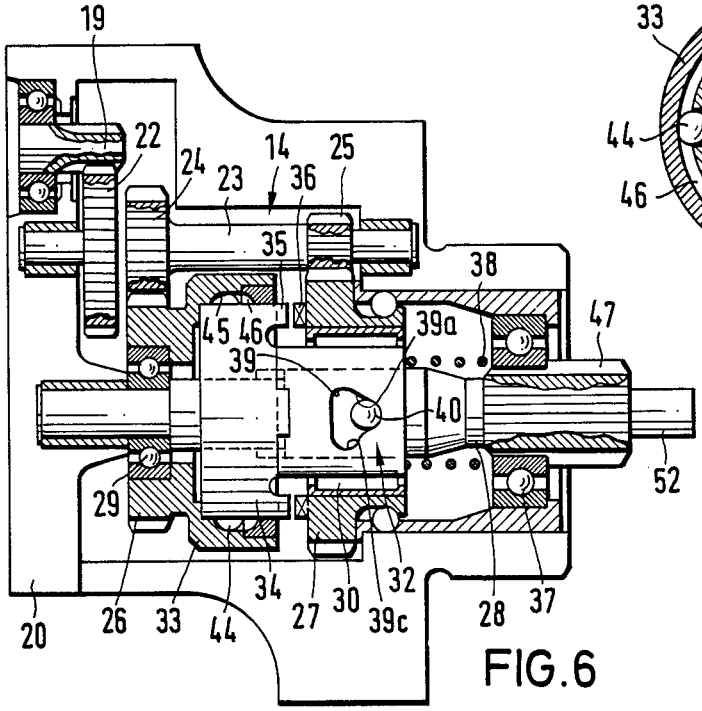
Figure 3:
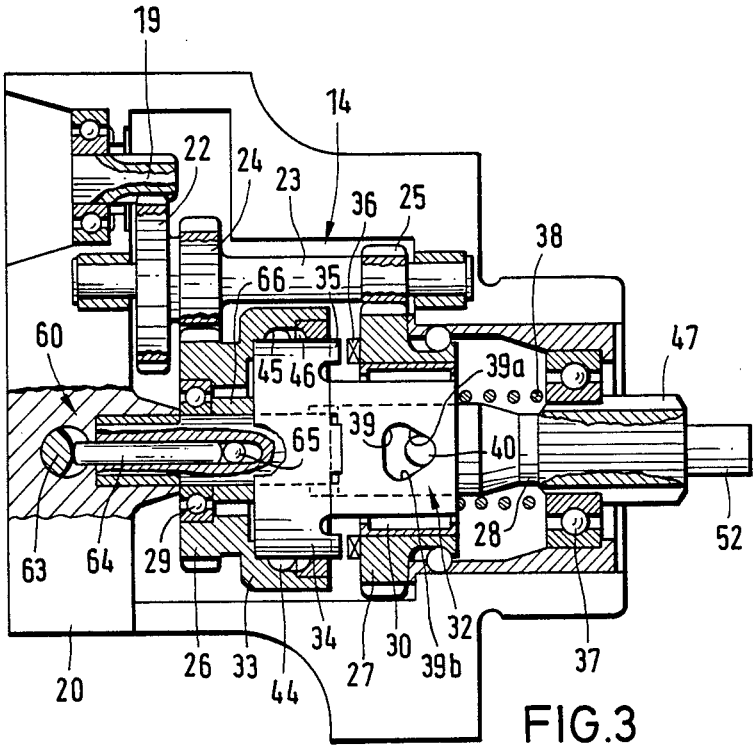

The Figs. show:

FIG. 1 a side view of the power wrench, partly in section,

FIG. 2 a section of the coupling controlled dependent on the rotational moment, with locking device, FIG. 3 a section along the line III—III in FIG. 2, FIG. 4 a section along the line IV—IV in FIG. 2, FIG. 5 a section along the line V—V in FIG. 2, and FIG. 6 as illustrated in FIG. 3, a coupling with a rest device.

The power wrench is arranged in the manner of a hand gun drill. It is provided with a driving device 10, which includes a rotational motor (not illustrated) that can be started by actuating a trigger 11. The direction of rotation can be selected by means of a direction switch 12. The driving device 10 is located in a separate housing on which the housing 13 is mounted that contains the coupling 14, which is dependant on the rotational moment. A housing 15 is mounted on the opposite end of said housing 13, containing a planet gear 16. The output shaft 17 of the planet gear has a head 18 to which a socket for wrenches can be applied to turn a screw.

The shaft 19 of the motor extends inwardly into the housing 13 from the front wall of the housing of the driving device 10. Said shaft 19 runs on a ball bearing 21 provided in the front wall 20 of said housing 13. The shaft 19 drives a gearwheel 22, which is fixedly mounted on distributing shaft 23. Both ends of said distributing shaft 23 run on bearings provided in the housing 13 and it bears two further gearwheels 24, 25 with different respective diameters. The larger gearwheel 24 meshes with the teeth of the first drive gear 26 and the gearwheel 25 meshes with the teeth of the second drive gear 27. Both drive gears 26 and 27 are arranged coaxial to the output shaft 28 of the coupling 14, which is dependent on the rotational moment. They are driven at different numbers of rotation by the distributing shaft 23, the number of rotations of the drive gear 26 being higher than that of the second drive gear 27. Said first drive gear 26 runs on a ball bearing 29 on the output shaft 28 and the second drive gear 27 runs on a roller bearing 30 on a cylindrical projection 31 of the coupling member 32. A bucket-shaped coupling body 33 extends from said first drive gear 26 towards said second drive gear 27. The ball housing 34 of the coupling member 32 extends into the openings of the coupling body 33. A ring of claws 35 protrudes from the ball housing 34 towards the second drive gear 27. Said claws 35 can mesh with claws 36 provided at the front part of said second drive gear 27, when the coupling member 32 is shifted towards said second drive gear 27.

The output end of output shaft 28 runs on a ball bearing 37 in the housing 13. A spring 38, which pushes the coupling member 32 towards first drive gear 26 is supported on the also rotating ring of ball bearing 37.

The peripheral surface of said cylindrical projection 31 of said coupling member 32 is provided with two guide curves 39 in the shape of mutually opposite triangular openings 39. The ends of a pin-shaped guiding member 40, which traverses the output shaft 28, protrude into said openings. Through the guide curves 39 and the guiding member 40 meshing therein, it is achieved that the output shaft 28 always rotates with the cylindrical projection of the coupling member 32; however, slight relative rotations coupling are possible within the openings provided by the guide curves 39. Each of said openings 39 has the shape of a equilateral triangle, the top of which is directed parallel to the axis of the output shaft 28 and against the pre-stress of the spring 38. The triangles are symmetric with respect to the axis of the output shaft, so that each guide curve 39 provides two inclined walls **39*a*, 39*b* with opposite slopes (FIG. 3), along which the guiding member 40 can slide. If the load moment occurring at the output shaft 28 surpasses the limiting value, the guiding member 40 shifts out of the points of the triangular guide curves 39 and slides along said walls 39*a* or 39*b*, which causes the coupling member 32 to disengage from the coupling body 33 and to mesh with the second drive gear 27 via the claws 35**.

FIG. 4 is a cross-section of the first engaging coupling, which is constituted by said coupling body 33 and ball housing 34. Ball housing 34 contains several ball catches, each of which includes a spring 43 provided in a radial pocket bore 42 in the ball housing 34 and a ball 44, pressed outward by the spring 43. Said balls 44 run in a driving track 45 provided on the inside of said coupling body 33. The diameter of said driving track 45 varies along its periphery, e.g. it has openings or recesses (unnumbered in FIG. 4) into which the balls 44 can penetrate. An opening is provided for each ball 44 and all openings are arranged such that all balls 44 can rest in their respective openings at the same time. Up to a certain rotational moment, the fact that the balls 44 are pressed into said openings by said springs 43 results in a rotational pulling of the coupling member 32 with the coupling body 33, if the balls 44 are in the driving track 45.

Adjacent to said driving track 45 an idle run track 46 is provided in the coupling body 33, the peripheral surface of said track not being provided with openings, but having a constant diameter (FIG. 5). If the coupling member 32, usually pushed towards the drive gear 26 by the spring 38, shifts towards the drive gear 27, thereby compressing the spring 38, the balls 44 move from the driving track 45 into the idle run track 46. In this state, the coupling member 32 is rotationally disengaged from the coupling body 33. At the same time, the claws 35 and 36 engage, so that the coupling member 32 is engaged with and turned by the drive gear 27.

The end of the output shaft 28 that protrudes from the housing 13 is provided with teeth that represent the sun wheel 47 of the first gear stage **16*a* (FIG. 1) of the planet gear 16. Said first gear is provided with planet wheels 48, the teeth of which mesh with the sun wheel 47 and which roll on the inner teeth 49 of the housing 15. Said planet wheels run on axles 50 that protrude from a bearing body 51 in which also the end 52 of the output shaft 28 runs. The bearing body 51 also represents the sun wheel 53 of the second gear stage 16*b*, the planet wheels 54 of which also mesh with the inner teeth 49 of the housing 15. The planet wheels 54 run on axles 55 that protrude from the bearing body 56. Said bearing body 56 is integrally connected with the output shaft 17 that runs in a bearing 57 at the end of the housing 15. Said bearing 57 is accommodated in a head piece 58 having an outer profile 59** for the application of an external support element (not illustrated) to divert the reaction power occurring at the turning of a screw to a stationary abutting part.

To tighten a screw, a socket for wrenches, which is then connected to the screw to be turned, is applied to the head 18 of the output shaft 17. The driving device 10 rotates the distributing shaft 23, thereby simultaneously rotating the drive gears 26 and 27 at different numbers of rotations. As long as the screw driving moment is low, the spring 38 will press the coupling member 32 against the drive gear 26, so that the balls 44 are in the driving track 45 and the coupling member 32 is driven by the drive gear 26 via the coupling body 33. Since in this state the claws 35, 36 are not engaged, the drive gear runs idly on the coupling member 32. Thus, the rotation of the output shaft 28 is reduced by the planet gear 16 and transmitted to the screw via the output shaft 17. The coupling 14, switching dependent on the load, is arranged between the driving device 10 and the planet gear 16, where the rotational moments to be transmitted are comparatively low, so that the coupling 14 can be of small size.

If the load moment of the output shaft 28 surpasses the limiting value, the coupling member 32 shifts together with the guiding member 40 along the walls **39*a* of the guide curve 39, so that the coupling member 32 moves towards the drive gear 27. Thereby, the balls 44 move from the driving track 45 into the idle run track 46 and at the same time, the claws 35 and 36 mesh with each other. The output shaft 28 is now driven at a lower number of rotations and at a higher rotational moment by the gearwheels 25 and 27**. Said drive at a higher rotational moment and a lower number of rotations is continued until the screw is tightened. Thus, there is no constant switching between a high and a low number of rotations.

As can be seen from FIG. 1, the axle of the planet gear 16 runs coaxial to that of the output shaft 28. With regard thereto, the shaft 19 of the rotational drive 10 is laterally set off.

The fact that the engaging coupling 33, 34 can slide even when their parts are engaged provides a better protection of the coupling against damage. Moreover, drive impacts that may occur during the switching are prevented.

The engaging coupling according to FIGS. 2 to 5 is also provided with a locking device 60, which allows to hold the movable coupling member 32 in the load position against the pre-stress of the spring 38 after the limit number of rotations has been surpassed. When loosening tight screwed connections, it is possible that the loosening moment reaches a value that, over a longer period, is about equal to the switching moment of the coupling. If the rotational moment at which the switching of the coupling member 32 occurs, alternately exceeds or falls below said limiting moment, there would be a risk of exposing both engaging couplings 33, 34 and 35, 36 to an increased wear. The locking device 60 is to prevent this. It is provided with a rotatable hand lever 61 mounted on a shaft 62 running in the housing 13. Part of said shaft 62 is provided with cams 63, contacted by a pin 64, which is arranged in a bore of the output shaft 28, so as to be displaced in its longitudinal direction. Said pin 64 contacts a cross pin 65, the ends of which protrude from the output shaft 28 and engage in a jacket 66 that surrounds said output shaft. The coupling member 32 is pressed against said jacket 66 by the spring 38. Due to the cam part 63, a turning of the hand lever 61 advances the pin 64, whereby the jacket 66 pushes the coupling member 32 to the right as viewed in FIG. 2 into a position that corresponds to a high load moment and in which the claws 35, 36 mesh with each other, whereas the first engaging coupling 33, 34 is disengaged. If the first engaging coupling 33, 34 is disengaged because of a high load moment at the output shaft 28 and the claws 35, 36 are meshing with each other, the hand lever 61 can be turned without having to overcome a substantial counter force, so that the jacket 66 tracks the coupling member 32. Since the power transmission via the shaft 62, the cam part 63 and the pin 64 is self-locking, the coupling member 32 cannot be shifted back into the fast run position because of the tension provided by the spring 38, unless the hand lever 61 has previously been turned by hand to a position in which the jacket 66 is shifted away from the spring 38. If necessary, an rest device 67 can be provided, in which the hand lever 61 can be held in the operative and the non-operative position, respectively.

FIG. 6 shows a further embodiment, which is similar to that of the first embodiment, except that there is no locking device 60, but instead rest means is provided in the form of an engaging opening 39*c* in the guide curve 39. In the load position, the guiding member 40 engages in the engaging opening 39*c*. Said engagement in said engaging opening 39*c* requires less force than the disengagement from said engaging opening. That way, the switching behaviour of the coupling is provided with a hysteresis. This means that at an increasing load moment the switch-over to a lower number of rotations of the output shaft is effected at a lower rotational moment than the switch-over to the higher output number of rotations would be effected at a decreasing load moment. This way, a continuous switching of the coupling is avoided in the limit region of the critical load moment.

What is claimed is:

1. A power wrench comprising a drive coupling (14) having a distributing shaft (23) having first and second gears (24, 25) in respective driving relationship with a first drive gear (26) and a second drive gear (27), said first (26) and second (27) drive gears being driven at different rotational speeds by said distributing shaft first and second gears (24, 25), said first drive gear (26) being in driving relationship to a coupling member (32) through a first engaging coupling (33, 34) defined by first (33) and second (34) engaging coupling elements, said coupling member (32) being in driving relationship to an output shaft (28), said second drive gear (27) being in driving relationship to said coupling member (32) through a second engaging coupling (35, 36) defined by a third (35) and fourth (36) engaging coupling elements, said third (35) and fourth (36) engaging coupling elements being disposed for driving engagement between said second engaging coupling element (34) and said second drive gear (27), and means (38) for placing said first (33) and second (34) engaging coupling elements in driving relationship with each other up to a predetermined limiting rotational moment of said output shaft (28) at which said third (35) and fourth (36) engaging coupling elements come into driving relationship with each other.

2. The power wrench as defined in claim 1 including means (39, 40) for overriding said placing means (38) thereby interrupting the driving relationship between said first (33) and second (34) engaging coupling elements and placing said third (35) and fourth (36) engaging coupling elements in driving relationship with each other upon said output shaft (28) reaching the predetermined limiting rotational moment thereof.

3. The power wrench as defined in claim 1 including means (39, 40) for overriding said placing means (38) thereby interrupting the driving relationship between said first (33) and second (34) engaging coupling elements and placing said third (35) and fourth (36) engaging coupling elements in driving relationship with each other upon said output shaft (28) reaching the predetermined limiting rotational moment thereof, and said overriding means (39, 40) include a slidable connection between said output shaft (28) and said coupling member (32).

4. The power wrench as defined in claim 1 including means (39, 40) for overriding said placing means (38) thereby interrupting the driving relationship between said first (33) and second (34) engaging coupling elements and placing said third (35) and fourth (36) engaging coupling elements in driving relationship with each other upon said output shaft (28) reaching the predetermined limiting rotational moment thereof, and said overriding means (39, 40) include an axial slidable connection between said output shaft (28) and said coupling member (32).

5. The power wrench as defined in claim 1 including means (39, 40) for overriding said placing means (38) thereby interrupting the driving relationship between said first (33) and second (34) engaging coupling elements and placing said third (35) and fourth (36) engaging coupling elements in driving relationship with each other upon said output shaft (28) reaching the predetermined limiting rotational moment thereof, and said overriding means (39, 40) include an axial slidable connection between said output shaft (28) and said coupling member (32) in the form of a guiding member (40) in sliding relationship to a guide surface (39).

6. The power wrench as defined in claim 1 including means (39, 40) for overriding said placing means (38) thereby interrupting the driving relationship between said first (33) and second (34) engaging coupling elements and placing said third (35) and fourth (36) engaging coupling elements in driving relationship with each other upon said output shaft (28) reaching the predetermined limiting rotational moment thereof, and said overriding means (39, 40) include an axial slidable connection between said output shaft (28) and said coupling member (32) in the form of a guiding member (40) carried by said output shaft (28) in sliding relationship to a guide surface (39) of said coupling member (32).

7. The power wrench as defined in claim 1 including clutch means (44, 45, 46) for drivingly engaging and disengaging said first engaging coupling (33, 34).

8. The power wrench as defined in claim 1 including clutch means (44, 45, 46) for drivingly engaging and disengaging said first engaging coupling (33, 34) and said clutch means includes at least one ball (44) carried by one of said first (33) and second (34) engaging coupling elements and a ball track (45) carried by the other of said first (33) and second (34) engaging coupling elements.

9. The power wrench as defined in claim 1 including clutch means (44, 45, 46) for drivingly engaging and disengaging said first engaging coupling (33, 34), said clutch means includes at least one ball (44) carried by one of said first (33) and second (34) engaging coupling elements and a ball track (45) carried by the other of said first (33) and second (34) engaging coupling elements, said ball track (45) is a driving track, and an idle track (46) for receiving said at least one ball (44) when said third (35) and fourth (36) engaging coupling elements are in driving relationship with each other.

10. The power wrench as defined in claim 1 including a planetary gear system (16*a*) driven by said output shaft (28), and said output shaft (28) carries a sun gear (47) of said planetary gear system (16*a*).

11. The power wrench as defined in claim 1 including locking means (60) for locking the coupling member (32) in a position at which the first (33) and second (34) engaging coupling elements are not in driving relationship with each other and the third (35) and fourth (36) engaging coupling elements are in driving relationship with each other.

12. The power wrench as defined in claim 1 including means (39*c*, 40) for fixing the coupling member (32) with the third (35) and fourth (36) engaging coupling elements in driving relationship with each other after the predetermined limiting rotational moment has been surpassed.

13. The power wrench as defined in claim 1 including means (39*c*, 40) for fixing the coupling member (32) with the third (35) and fourth (36) engaging coupling elements in driving relationship with each other after the predetermined limiting rotational moment has been surpassed, and said fixing means (39*c*, 40) include an axial slidable connection between said output shaft (28) and said coupling member (32) in the form of a guide member (40) carried by said output shaft (28) in sliding relationship to a guide surface (39) of said coupling member (32).

14. The power wrench as defined in claim 5 wherein said guide surface (39) is defined by a generally triangular opening having a corner against which said guiding member (40) is urged by said placing means (38).

15. The power wrench as defined in claim 1 wherein said first and second gears (24, 25) are in axial spaced relationship to each other.

16. The power wrench as defined in claim 1 wherein said first and second gears (24, 25) are in axial spaced relationship to each other, and said first and second gears (24, 25) are constructed and arranged to impart different rotational speeds to the respective first and second drive gears (26, 27).

17. The power wrench as defined in claim 1 wherein said coupling member (32) is mounted for axial displacement on said output shaft (28) for selectively engaging one of said first and second drive gears (26, 27).

18. The power wrench as defined in claim 1 including biasing means (38) for biasing said coupling member (32) into driving engagement with said first drive gear (26), and said coupling member (32) being constructed and arranged to shift against the biasing force of said biasing means (38) when the torque of said output shaft (28) becomes higher than a predetermined value causing disengagement between said coupling member (32) and said first drive gear (26) and engagement between said coupling member (32) and said second drive gear (27).

19. The power wrench as defined in claim 15 wherein said coupling member (32) is mounted for axial displacement on said output shaft (28) for selectively engaging one of said first and second drive gears (26, 27).

20. The power wrench as defined in claim 15 including biasing means (38) for biasing said coupling member (32) into driving engagement with said first drive gear (26), and said coupling member (32) being constructed and arranged to shift against the biasing force of said biasing means (38) when the torque of said output shaft (28) becomes higher than a predetermined value causing disengagement between said coupling member (32) and said first drive gear (26) and engagement between said coupling member (32) and said second drive gear (27).

21. The power wrench as defined in claim 16 wherein said coupling member (32) is mounted for axial displacement on said output shaft (28) for selectively engaging one of said first and second drive gears (26, 27).

22. The power wrench as defined in claim 16 including biasing means (38) for biasing said coupling member (32) into driving engagement with said first drive gear (26), and said coupling member (32) being constructed and arranged to shift against the biasing force of said biasing means (38) when the torque of said output shaft (28) becomes higher than a predetermined value causing disengagement between said coupling member (32) and said first drive gear (226) and engagement between said coupling member (32) and said second drive gear (27).

23. The power wrench as defined in claim 22 wherein said coupling member (32) is mounted for axial displacement on said output shaft (28) for selectively engaging one of said first and second drive gears (26, 27).

* * * * *